United States Patent [19]

Barker

[11] Patent Number: 4,897,893

[45] Date of Patent: Feb. 6, 1990

[54] PAINT ROLLER FRAME INCLUDING SNAP-ON COVER FOR OUTBOARD END CAP

[75] Inventor: Richard L. Barker, Apple Creek, Ohio

[73] Assignee: The Wooster Brush Company, Wooster, Ohio

[21] Appl. No.: 340,432

[22] Filed: Apr. 19, 1989

[51] Int. Cl.[4] ..... B05C 17/02; B05C 1/08

[52] U.S. Cl. ..... 15/230.11; 29/110.5

[58] Field of Search ..... 15/230.11, 27; 29/110.5, 116.1, 117, 123, 118, 119; 401/197, 208

[56] References Cited

U.S. PATENT DOCUMENTS

| | | | |
|---|---|---|---|
| 2,520,863 | 8/1950 | Thomas et al. | 15/230.11 |
| 2,749,599 | 6/1956 | Kreger | 29/123 |
| 2,766,473 | 10/1956 | Thackara | 15/230.11 |
| 2,891,301 | 6/1959 | Conklin | 29/116.1 |
| 2,982,010 | 5/1961 | Johns | 29/116.1 |
| 4,467,509 | 8/1984 | Dezen | 29/119 |

*Primary Examiner*—Harvey C. Hornsby
*Assistant Examiner*—M. Spisich
*Attorney, Agent, or Firm*—Renner, Otto, Boisselle & Sklar

[57] ABSTRACT

Paint roller frame includes a snap-on cover for the outboard end cap. The cover has an end wall which extends the full radial extent of the outboard end cap and an axial skirt portion which has a greater axial length than the radial outermost surface of the outboard end cap. The cover is retained on the outboard end cap by an internal annular rib which has an axially outwardly facing inclined surface that engages a correspondingly axially inwardly inclined surface on the axial inner end of the radial outermost surface of the outboard end cap.

23 Claims, 1 Drawing Sheet

PAINT ROLLER FRAME INCLUDING SNAP-ON COVER FOR OUTBOARD END CAP

BACKGROUND OF THE INVENTION

This invention relates generally, as indicated, to a paint roller frame including a snap-on cover for the outboard end cap.

Paint roller frames, for example of the bent wire type, generally include a handle portion having a hand grip thereon and a shaft portion extending generally at right angles to the handle portion having a roller cage assembly including inboard and outboard end caps rotatably mounted thereon in spaced apart relation for rotatably supporting a roller cover. Preferably the paint roller frame is designed so that the shaft portion does not protrude outwardly beyond the outboard end cap or otherwise the shaft portion will prevent the roller from getting into corners and the like.

To mount the roller cage assembly on the shaft portion without having the shaft portion protrude beyond the outboard end cap, the outboard end cap may be provided with a counterbore or recess for receipt of the outer end of the shaft portion and suitable fastener therefor. To conceal this connection and prevent paint or other material from collecting in the recess, it has been common practice to provide a cover for the outer end of the recess. However, heretofore such covers were oftentimes not very effectively retained in place. Also, grooves or gaps were oftentimes left around the covers which are not only unsightly, but may also collect paint or other material, causing undesirable dripping and making the paint roller frame more difficult to clean.

SUMMARY OF THE INVENTION

With the foregoing in mind, it is a principal object of this invention to provide a paint roller frame of the type generally indicated but with a cover for the outboard end cap that extends completely over the outboard end cap to eliminate any grooves or gaps therebetween.

Another object is to provide such a paint roller frame with a cover for the outboard end cap that has a surrounding skirt portion of increased length to provide increased support for the paint roller cover.

Still another object is to provide such a paint roller frame with a cover for the outboard end cap that snaps over a radial outer flange portion on the outboard end cap.

Yet another object is to provide such a paint roller frame with a cover for the outboard end cap that has an internal tapered rib intermediate the ends thereof which is cammed against the axial inner end of the radial outer flange portion of the outboard end cap to provide a snug fit between the cover and outboard end cap.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figures 1, 2:
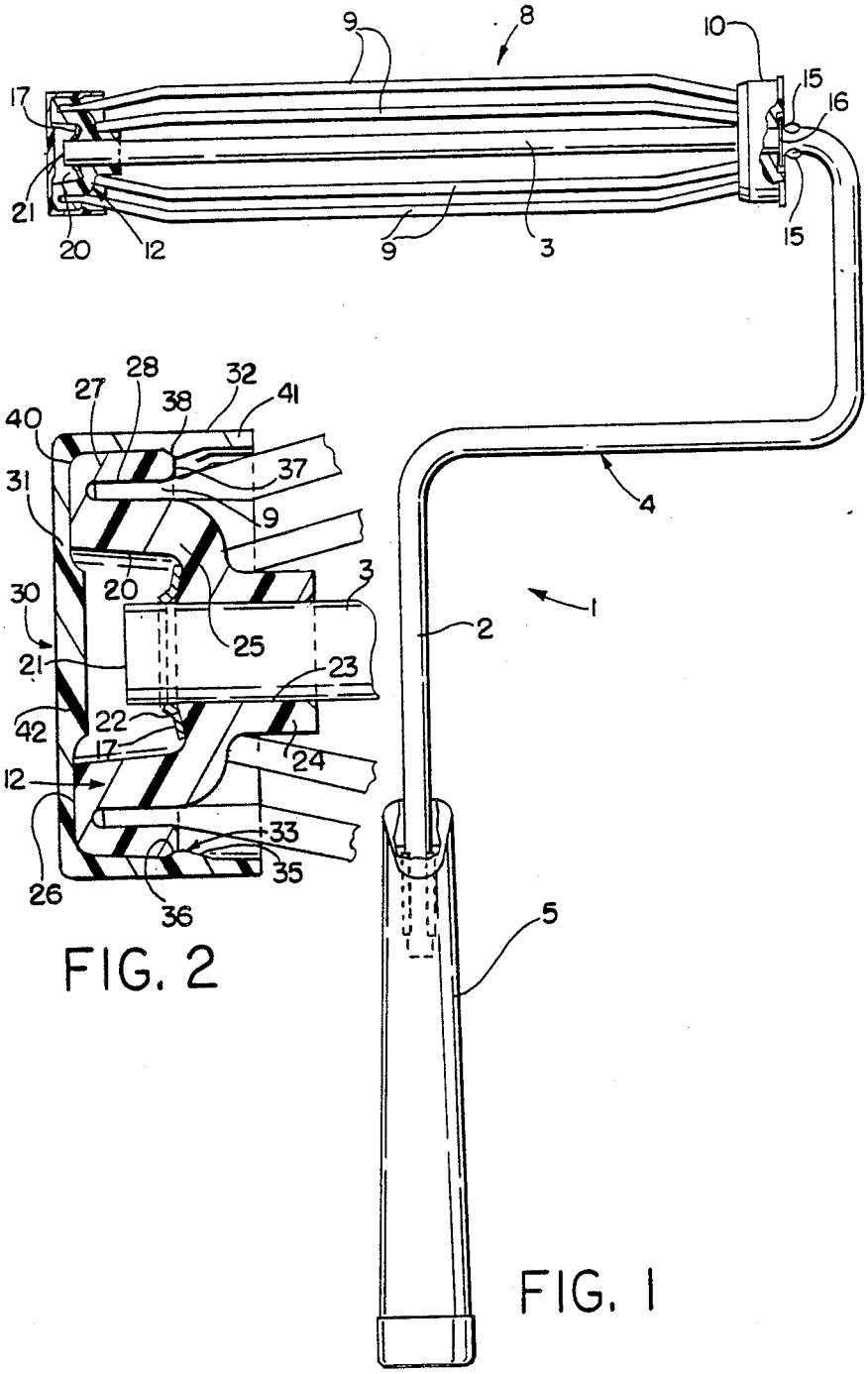
FIG. 1 is a top plan view of a preferred form of paint roller frame in accordance with this invention having portions of the inboard and outboard end caps partially broken away or in section to show the manner in which the end caps are mounted on the roller frame shaft.
FIG. 2 is an enlarged sectional view through the outboard end cap and surrounding cover.

Referring now in detail to the drawing and initially to FIG. 1, there is shown a preferred form of paint roller frame 1 in accordance with this invention including a handle portion 2 and shaft portion 3 which may, for example, be made out of wire stock 4 bent to the desired shape with the shaft portion 3 extending generally at right angles to the handle portion 2. Suitably secured to the outer end of the handle portion 2 is a conventional plastic or wooden handle 5.

Rotatably mounted on the shaft portion 3 is a roller cage assembly 8 which in the form illustrated herein by way of example includes a plurality of spring rods 9 having opposite ends suitably attached to inboard and outboard end caps 10, 12. The spring rods 9 will frictionally engage the inner diameter of a conventional roller cover (not shown) in a manner well known in the art. The inboard and outboard end caps 10, 12 are desirably molded out of a suitably rigid plastic material such as nylon.

The roller cage assembly 8 may be retained on the shaft portion 3 in any suitable manner, for example, by staking the inner end of the shaft portion 3 to provide protrusions or dimples 15 thereon adjacent the outer end of the inboard end cap 10, with a washer 16 interposed therebetween, and providing a push-on type fastener 17 on the outer end of the shaft 3 or peening over the outer end of the shaft, with a washer in-between.

To prevent the shaft 3 from interfering with the use of the roller frame 1 in corners or the like, the shaft portion 3 does not protrude axially outwardly beyond the outboard end cap 12. Instead, the outboard end cap 12 is provided with a countersunk cavity or recess 20 for receipt of the fastener 17 and outermost end 21 of the shaft portion 3. As best seen in FIG. 2, the cavity 20 may have a frusto-conical end face 22 surrounding the shaft opening 23 into the cavity for seating engagement by the push-on type fastener 17 or the like. However, it will be apparent that other arrangements than the fastener 17 could be used to retain the roller cage assembly 8 on the shaft 3 such as peening over the end of the shaft 3 if desired.

Referring further to FIG. 2, the outboard end cap 12 includes a cylindrical bearing portion 24 containing the shaft opening 23 and an enlarged annular hub portion 25 containing the cavity 20. The axial inner end of the annular hub portion 25 is integral with the bearing portion 24, whereas the axial outer end of the annular hub portion 25 includes an end wall portion 26 that extends radially outwardly beyond the hub portion for supporting an axially inwardly extending cylindrical flange portion 27 in radially outwardly spaced relation from the annular hub portion 25, thus defining an annular slot or groove 28 therebetween in which the ends of the spring rods 9 are secured in conventional manner.

After the roller cage assembly 8 has been inserted onto the shaft 3 and secured in place as shown in FIG. 2, a cover 30, which is also desirably made of a suitable plastic such as nylon, is inserted over the outboard end cap 12 to conceal the shaft-fastener connection and prevent paint or other material from collecting within the cavity 20 during use of the paint roller frame 1. According to the present invention, the cover 30 fits completely over the outboard end cap 12 to eliminate any grooves or gaps therebetween in which paint or other material might otherwise collect and to provide a smooth, uninterrupted cylindrical support surface around the outboard end cap 12 for supporting a paint roller cover thereon. To that end, the cover 30 includes a generally flat, disc-like end wall 31 covering the full radial extent of the outboard end cap 12 and a cylindrical skirt portion 32 surrounding the flange portion 27 and extending axially inwardly beyond the axial innermost end of such flange portion. Intermediate the length of the skirt portion 32 is an internal annular rib 33 which provides a snap fit between the cover 30 and outboard end cap 12 as described hereafter.

Preferably, the internal rib 33 has oppositely inclined end walls 35, 36 at opposite ends thereof which are inclined at a suitable angle, for example, approximately 20° to the longitudinal axis. Also, the axial innermost end 37 of the flange portion 27 of the outboard end cap 12 preferably has an inclined external surface 38 similarly beveled or inclined at the same 20° angle as the end wall 36 whereby when the end wall 36 bears against the external surface 38, the interior of the cover end wall 31 is pressed up against the outer face 26 of the outboard end cap 12 as shown in FIG. 2.

Installation of the cover 30 is facilitated by the opposite inclined face 35 of the annular rib 33 which acts as a ramp, causing the annular skirt portion 32 to be cammed over the flange portion 27 during insertion of the cover 30 over the outboard end cap 12. When the inclined face 35 of the annular rib 33 initially engages the rounded outer corner 40 between the end face 26 and flange portion 27 of the outboard end cap, pressure forces the skirt portion 32 to expand radially. This radial stretching continues as the skirt portion 32 is forced axially inwardly along the length of the flange portion 27. When the annular rib 33 reaches the beveled end face 38 of the flange portion 27, the plastic memory of the nylon cover 30 causes the skirt portion 32 to contract to maintain close pressure contact between the two mating inclined surfaces 36, 38 which effectively causes the end wall 31 of the cover 30 to be cammed up snugly against the end wall 26 of the outboard end cap 12 and effectively prevents removal of the cover from the outboard end cap. Upon completion of the assembly as shown in FIG. 2, the cover 30 tightly surrounds the outboard end cap 12, thus preventing any relative axial movement therebetween. Also, the axial inner end 41 of the skirt portion 32 of the cover 30 desirably extends axially inwardly beyond the flange portion 27 of the outboard end cap 12 to provide increased support for the roller cover without interfering with the spring action of the spring rods 9.

To give the cover skirt portion 32 the desired flexibility, the skirt portion desirably has a relatively thin wall thickness of, for example, approximately ⅛ inch. The thickness of the end wall 31 of the cover 30 may be made even less, for example, approximately 1/16 inch thick. However, in that event the thickness of the center portion 42 of the end wall 31 which overlies the cavity 20 is desirably increased, for example, to approximately 3/32 inch, so that the end wall 31 is not translucent in the region of the cavity in order to conceal the shaft-fastener connection.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A paint roller frame comprising a handle portion, a shaft portion extending generally at a right angle to said handle portion, and a roller cage assembly rotatably mounted on said shaft portion for supporting a roller cover thereon, said roller cage assembly including an outboard end cap having a radial outer wall portion, an axial outer end wall, and an axially outwardly opening cavity, said cavity receiving a free end of said shaft portion, and fastening means in said cavity for preventing removal of said outboard end cap from said shaft portion, and a cover inserted over said outboard end cap, said cover having an end wall extending the full radial extent of said axial outer end wall of said outboard end cap, and an axial skirt portion extending the full axial extent of said radial outer wall portion, and cooperating surface means on said radial outer wall portion and skirt portion for retaining said cover on said outboard end cap.

2. The frame of claim 1 wherein said cooperating surface means comprise inclined mating surfaces on said radial outer wall portion and skirt portion.

3. The frame of claim 1 wherein said cooperating surface means comprise an internal annular rib on said skirt portion which is engageable with an axial inner end portion of said radial outer wall portion.

4. The frame of claim 3 wherein said internal rib on said skirt portion and said axial inner end portion of said radial outer wall portion have inclined mating surfaces.

5. The frame of claim 1 wherein said skirt portion extends axially inwardly beyond said radial outer wall portion.

6. The frame of claim 5 wherein said cooperating surface means comprise an internal annular rib intermediate the ends of said skirt portion, and mating surface means on said radial outer wall portion engageable by said rib.

7. The frame of claim 6 wherein said rib has an axially outwardly facing inclined surface engageable with an axially inwardly facing inclined surface on said radial outer wall portion.

8. The frame of claim 7 wherein said axially inwardly facing inclined surface on said radial outer wall portion is located at the axial inner end of said radial outer wall portion.

9. The frame of claim 8 wherein said inclined surfaces on said rib and radial outer wall portion are inclined at substantially the same angle.

10. The frame of claim 7 wherein said rib also has an axially inwardly facing inclined surface axially inwardly spaced from said axially outwardly facing inclined surface to facilitate camming of said skirt portion over said radial outer wall portion.

11. The frame of claim 10 wherein said outboard end cap includes a rounded outer corner between said axial outer end wall and said radial outer wall portion which is engaged by said axially inwardly facing inclined surface on said rib to facilitate camming of said skirt portion over said radial outer wall portion.

12. The frame of claim 1 wherein said roller cage assembly further includes spring rods for frictionally retaining a roller cover on said roller cage assembly, said outboard end cap having an annular hub portion radially inwardly spaced from said radial outer wall portion defining a circumferential slot therebetween for receiving one end of said spring rods.

13. The frame of claim 12 wherein said skirt portion extends axially inwardly beyond said radial outer wall portion to provide increased support for a roller cover without interfering with said spring rods.

14. The frame of claim 12 wherein said cavity is formed in said hub portion of said outboard end cap.

15. The frame of claim 1 wherein said cover is made of a resilient plastic.

16. The frame of claim 15 wherein said cover end wall has a center portion overlying said cavity which has a greater thickness than the rest of said cover end wall.

17. The frame of claim 16 wherein said cover end wall has a substantially flat outer face, and a substantially flat inner face except for a thickened center portion which extends partway into said cavity.

18. The frame of claim 1 wherein said skirt portion has a smooth external surface over its entire length.

19. A paint roller frame comprising a handle portion, a shaft portion extending generally at a right angle to said handle portion, inboard and outboard end caps rotatably mounted on said shaft portion in spaced apart relation for supporting a roller cover thereon, said outboard end cap having an axially outwardly opening cavity therein containing a free end of said shaft portion, and fastening means in said cavity for preventing removal of said outboard end cap from said shaft portion, and a cover inserted over said outboard end cap, said outboard end cap having an axial outer end wall surrounding said cavity, and a radial outer wall portion extending axially inwardly from said axial outer wall portion, and said cover having an end wall extending the full radial extent of said outboard end cap, and an axial skirt portion having an axial length greater than said radial outer wall portion, said skirt portion having an internal annular rib intermediate the ends of said skirt portion engageable with an axial inner end of said radial outer wall portion for retaining said cover on said outboard end cap.

20. The frame of claim 19 wherein said internal rib on said skirt portion has an axially outwardly facing inclined surface engageable with an axially inwardly facing inclined surface on the axial inner end of said radial outer wall portion.

21. The frame of claim 20 wherein said inclined surfaces on said rib and radial outer wall portion are inclined at substantially the same angle.

22. The frame of claim 20 wherein said rib also has an axially inwardly facing inclined surface axially inwardly of said axially outwardly inclined surface to facilitate camming of said skirt portion over said radial outer wall portion.

23. The frame of claim 22 wherein said outboard end cap includes a rounded outer corner between said axial outer end wall and said radial outer wall portion of said outboard end cap which is engaged by said axially inwardly facing inclined surface on said internal rib to facilitate camming of said skirt portion over said radial outer wall portion during insertion of said cover over said outboard end cap.

* * * * *